US005350164A

United States Patent [19]

Coombs

[11] Patent Number: 5,350,164

[45] Date of Patent: Sep. 27, 1994

[54] SORTER OPERATED JOGGER

[75] Inventor: Peter M. Coombs, Tustin, Calif.

[73] Assignee: Gradco (Japan) Ltd., Tokyo, Japan

[21] Appl. No.: 889,633

[22] Filed: May 28, 1992

[51] Int. Cl.[5] ..... B42B 2/00; B65H 31/36

[52] U.S. Cl. ..... 270/53; 271/221

[58] Field of Search ..... 271/221, 222, 293, 294; 270/53, 58

[56] References Cited

U.S. PATENT DOCUMENTS

| | | | |
|---|---|---|---|
| 4,397,461 | 8/1983 | DuBois et al. | 271/293 |
| 4,687,191 | 8/1987 | Stemmle | 270/53 |
| 5,193,801 | 3/1993 | Coombs et al. | 271/293 |

*Primary Examiner*—Edward K. Look
*Assistant Examiner*—John Ryznic
*Attorney, Agent, or Firm*—Newton H. Lee, Jr.

[57] ABSTRACT

A pivoted bin sorter has a stapler for finishing sets of sheets in the bin trays and a jogger operated by a camming action of the trays as the trays are moved from a position in which sheets are deposited in the trays to a position above the sheet receiving position. The camming action is caused by a cam projection on the jogger which engages a side edge of a slot in the trays as the trays are moved relative to the jogger. The jogger moves the sheets laterally of the direction of sheet movement into the trays against a registration surface opposed to the jogger. The registration edge is a vertical surface provided by a wall of the frame structure at the opposite side of the trays from the jogger. During upward movement of the trays, the stapler is moved to a stapling position and displaces the sets of sheets in trays above the sheet inlet position in the direction of sheet infeed.

7 Claims, 4 Drawing Sheets

SORTER OPERATED JOGGER

BACKGROUND OF THE INVENTION

In the collating of sheets of paper into sets of documents or in segregating sets of sheets in so called sorting machines, it is desired that the sheets forming the sets or documents be aligned or registered to provide a neat package, particularly when the set of sheets or document is to be bound or stapled.

In a variety of moving bin sorters, the trays are arranged in a stack of vertically spaced trays which extend horizontally but at an incline from the sheet entry end of the trays, so that the trailing edge of sheets tend to gravitate into alignment against a flange at the lower end of the trays as the sheets are fed into the trays. At the side of the sheets normal to the trailing edge, the sheets may not be closely registered, so that when the set is removed for binding or stapling, an operator may hand jog the sheets into registration in both directions.

Automatic joggers have evolved which are operated to laterally displace sheets in the sorting trays against a standard or vertical wall forming a part of the frame structure for the sorter or against side flanges on the trays. Such joggers have typically been mechanically operated and include a member moved laterally of the sorter trays to engage and move the sheets into engagement with the standard or side edge flange, as referred to above.

An example of such a jogger is illustrated in U.S. Pat. No. 4,928,944. In this construction, jogging of the sheets to provide neat, edge registered sets is important in that the sets are stapled while in the trays by a stapler moved to a stapling position as the trays containing the sets of sheets are successively moved to the stapler. In other sorters, sets of sheets may be gripped in a set moving device which carries the clamped set to a stapler, so that edge registration of sheets at the time when the set is gripped is important from the standpoint of stapling a neat set.

Such joggers have involved relatively complicated mechanisms and timing means to cause the jogging action in a sorter which otherwise, has been simplified and made of compact form due to the fact that the trays are sequentially opened to provide a large sheet entry space between trays, while otherwise the trays are close together.

Examples of such sorters, other than that shown in the above referenced U.S. Pat. No. 4,738,443, are the sorters shown in Lawrence U.S. Pat. No. 4,911,424, DuBois U.S. Pat. No. 4,478,406 and my U.S. Pat. No. 5,255,902. In the latter, the sets of sheets are finished or stapled in the trays, so that edge registration is more important than in the other examples in which edge registration is, nevertheless, important.

SUMMARY OF THE INVENTION

The present invention involves registering the sheets supplied to the trays of a moving bin sorter by taking advantage of the tray movement to provide for actuation of a jogger thereby automatically effecting edge registration of the sheets in each set in the trays as they are being moved from a sheet receiving position.

More particularly, the invention contemplates a flexible jogger finger extending vertically with respect to the trays of a moving bin sorter, wherein a cam action is provided between the jogger finger and the successive trays to move the jogging finger with respect to the sheet deposited in the tray to move the sheet, if necessary, into engagement with a reference or registration surface opposed to the finger, such registration surface being on the tray or on a portion of the frame or some other location providing a registration surface located at a right angle to the lower end of the tray when the trays extend upwardly at an incline in the direction of sheet feed.

The present invention is especially applicable to sorting machines of the moving bin type shown in my U.S. Pat. No. 5,255,902 referred to above, which has a stapler moved into a stapling position as the trays are sequentially moved so that the sets are jogged finally by the present invention prior to stapling.

The invention possess other features and advantages which will become apparent from the following description of the illustrative embodiment shown in the accompanying drawings forming a part thereof.

DESCRIPTION OF THE PREFERRED EMBODIMENT

Figure 1:
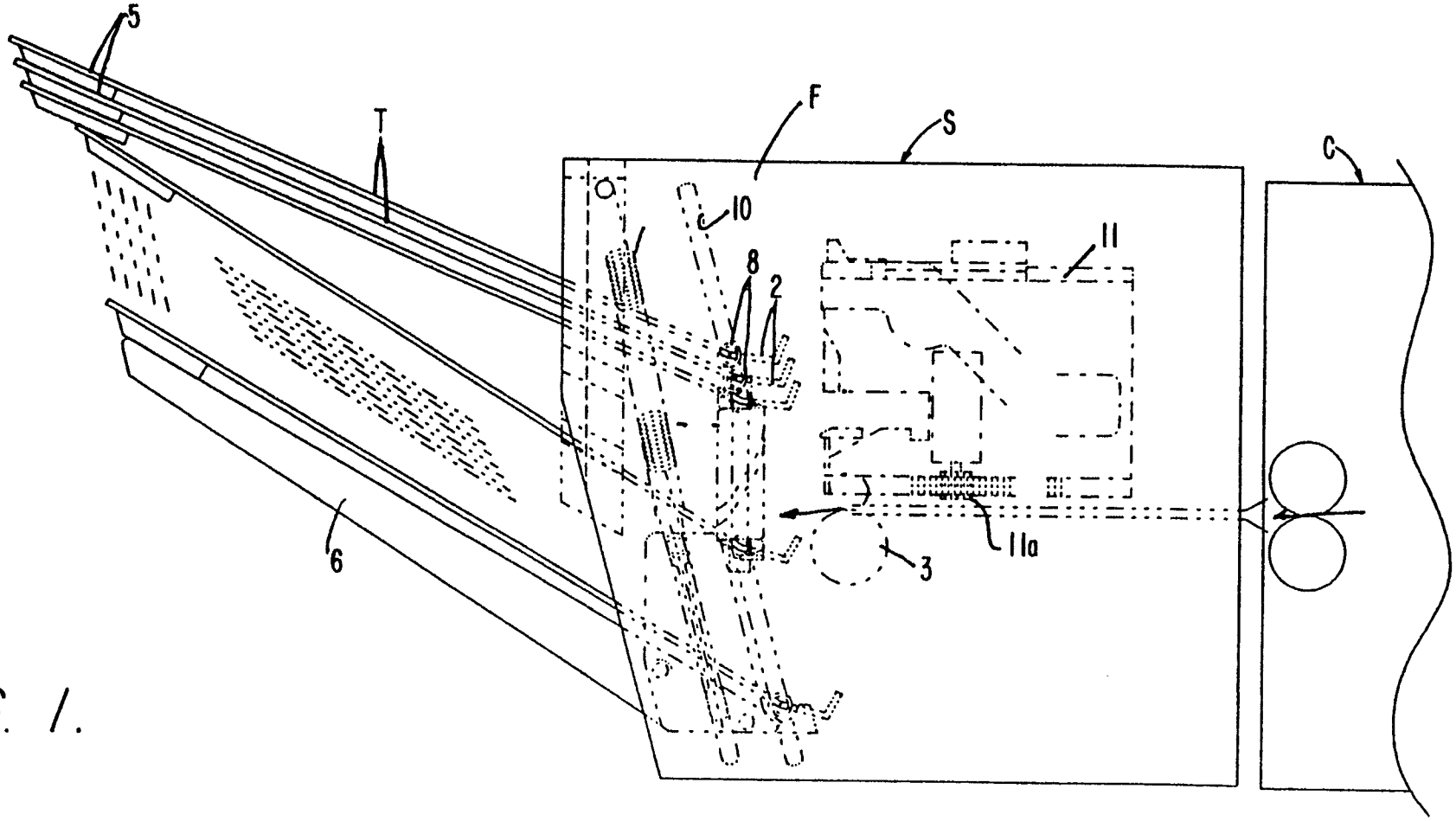
FIG. 1 is an elevational view of a moving bin sorter made in accordance with the invention.

Referring first to FIG. 1, sorter apparatus S is shown of a type to which the invention is applicable. The sorter may take various forms wherein a stack of trays T is mounted in a frame structure F and the trays extend horizontally in such a way that the ends 2 of the trays adjacent to a sheet infeed 3 are vertically shiftable between positions closely spaced and in which an enlarged sheet entry space 4 is provided. Sheets of paper are supplied from an office copier or printer C.

At their outer ends 5, the trays are mounted to pivot. In this embodiment, the outer tray ends pivot one on the other and the lower tray is supported on the outer end of a vertically shiftable support arm 6 which is biased upwardly by a spring 7 which causes pivot pins or trunnions 8 to move upwardly into engagement with cam means 9 adapted to be rotated to move the trunnion upwardly or downwardly in guide slots 10 in the frame.

Figure 2:
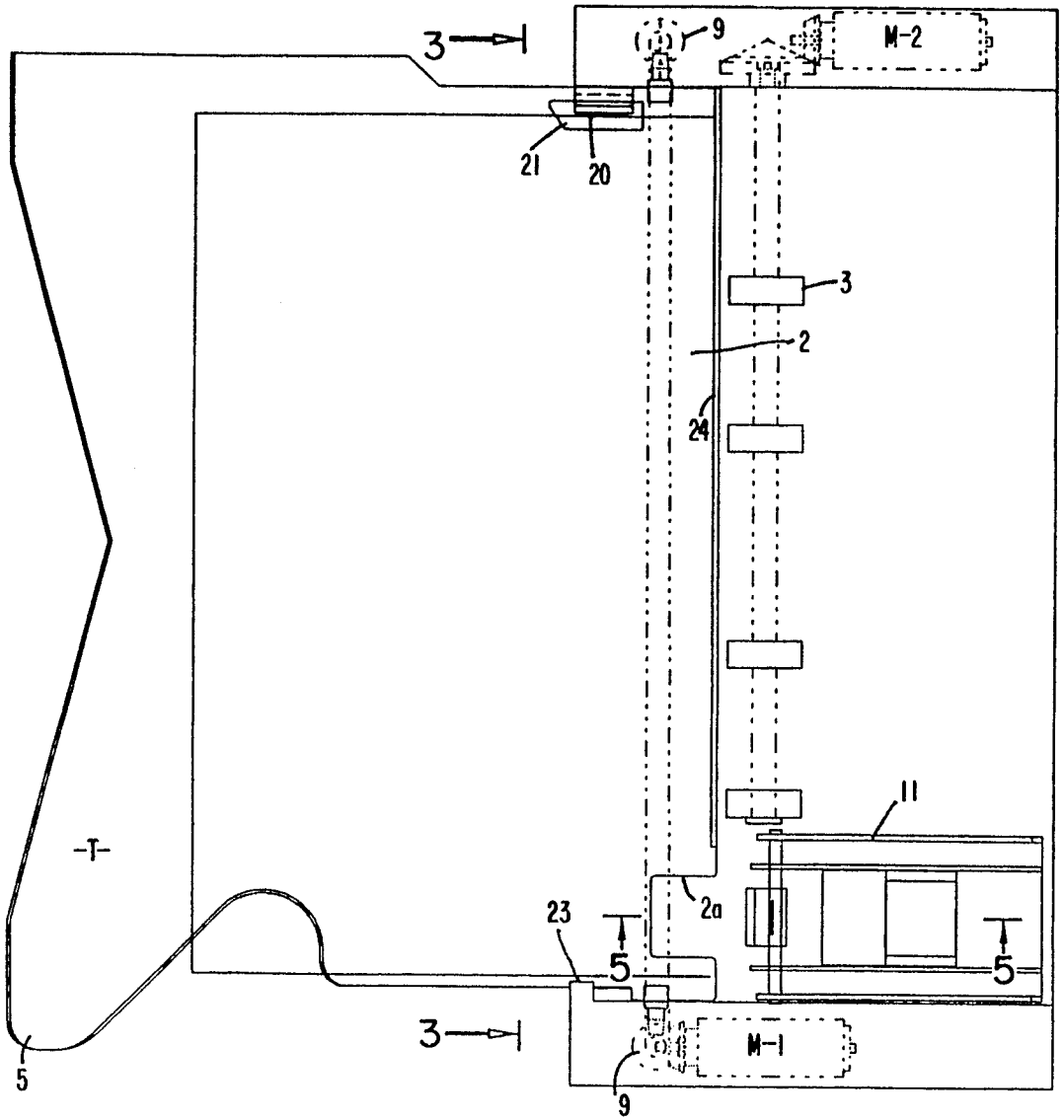
FIG. 2 is a top plan of the sorter of FIG. 1.
Figure 5:
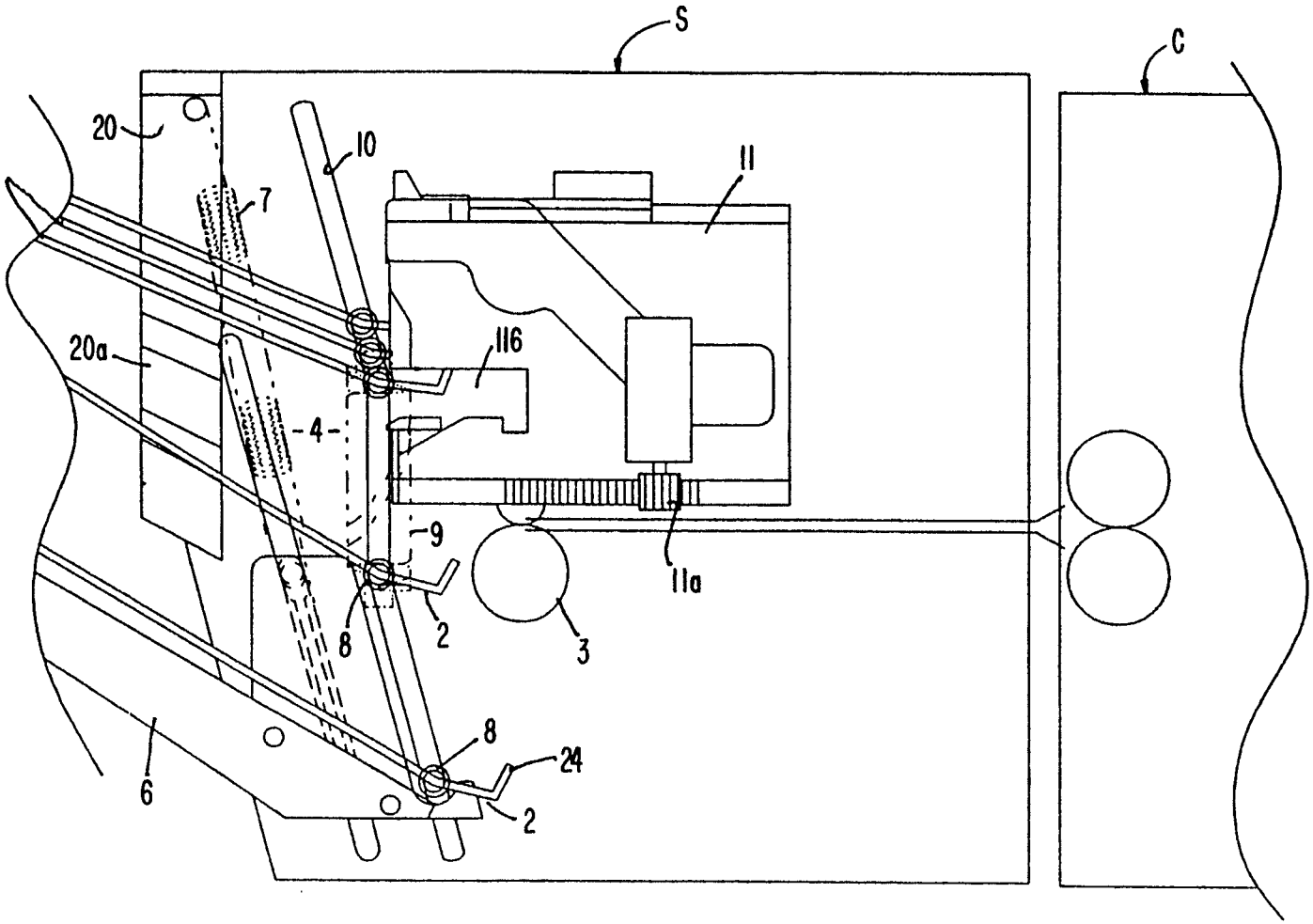
FIG. 5 is a vertical section on the line 5–5 of FIG. 2, showing the stapler in a stapling position.

The illustrated sorter also includes stapler 11 adapted to be shifted by rack and pinion 11a or other means between a retracted or non-stapling position, as shown in FIGS. 1 and 2, to a stapling position shown in FIG. 5, for inserting a staple in the sets of sheets received by the trays during sorting operations following set alignment or jogging in accordance with the invention.

The details of such a sorter are more particularly disclosed in my U.S. Pat. No. 5,255,902. Other sorters are also useful in the practice of the invention, such as the moving tray sorters of Lawrence U.S. Pat. Nos. 4,343,463 and 4,911,424, DuBois and Hamma U.S. Pat. No. 4,328,963 or DuBois U.S. Pat. No. 4,478,406. The common function in such sorters is the movement of the trays, and that such movement is employed in the present invention to cause the jogging function.

In the illustrated embodiment, the jogger is in the form of an inherently resilient jogging finger 20 mounted at one end on the frame structure, at one side thereof. The trays are provided with slots 21 through which the jogger extends upwardly. One edge 22 of the tray at the slots provides an operating surface for engaging and flexing the jogger finger towards the other side of the tray as the tray is moved upwardly by the tray shifting cams to the upper position above the cams from the lower position below the cams, following entry of a sheet, as well as, in the form shown, being flexed in a jogging motion during downward movement of the trays from above to below the cams during the sorting operations. In the form shown the jogger finger 20 has a cam projection 20*a* having wedge or cam surfaces which cause the finger to be flexed laterally of the sorter trays as the trays are moved upwardly and downwardly and the cam projection 20*a* on the flexible finger passes through slots 21 in the trays and engages the edge 22 of the slots. It will be understood that other jogging finger constructions may be employed to take advantage of the jogging action caused by the tray movement, such as a vertical bar normally biased towards the edge 22 of the tray at the slot 21.

At the side of the trays opposite the jogger finger is a straight vertical wall or registration surface 23 extended vertically and at a right angle to the direction in which sheets are fed into the trays and at a right angle, also, to a lower end flange 24 on each tray which extend upwardly at an incline at the sheet entry location.

Figure 4:
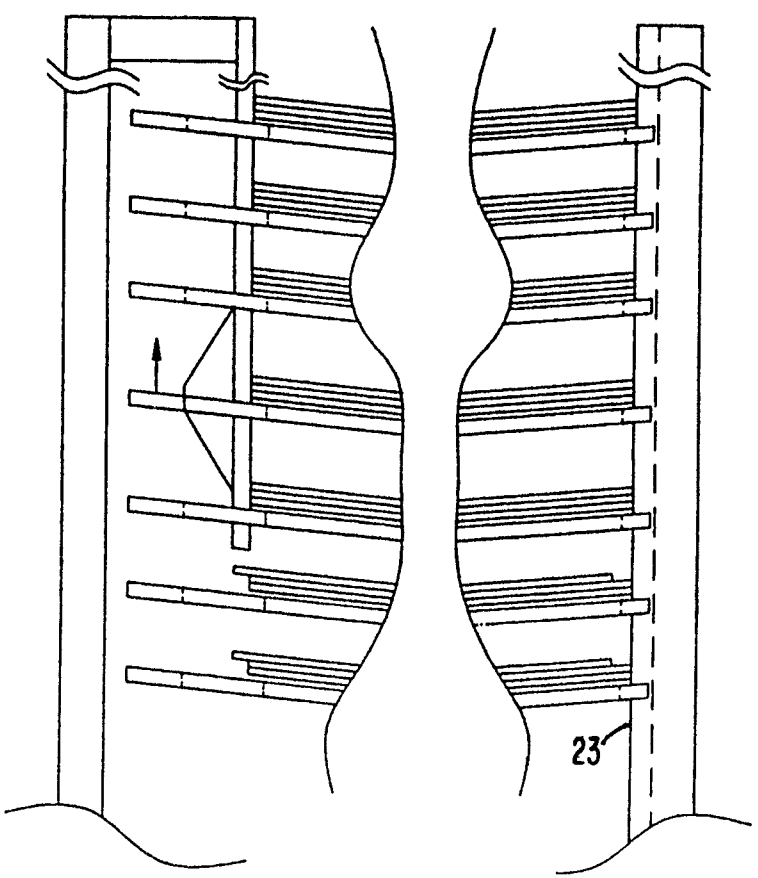
FIG. 4 is a view corresponding with FIG. 3, but showing the jogger finger in its jogging position.
Figure 3:
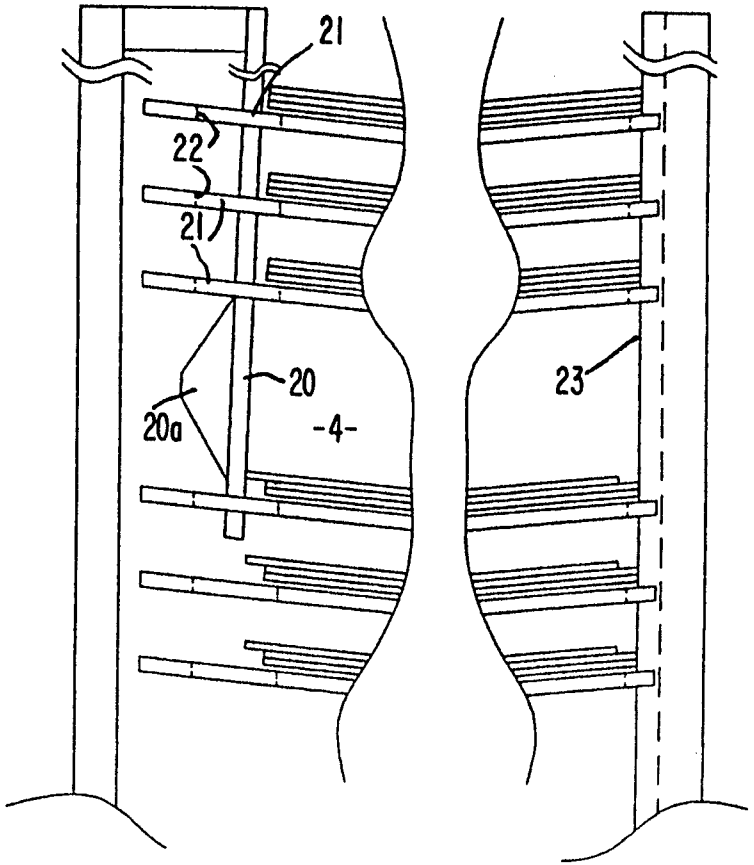
FIG. 3 is a detail view in vertical section on the lines 3—3 of FIG. 2 through the trays of the sorter showing the jogger finger in an inactive position.

The surface 23, therefore, provides an edge registration surface against which the sheets in the trays are forced by the jogger finger as the trays are vertically shifted, as seen in FIGS. 3 and 4. If preferred, the registration surface may be on the tray, but, in any case, the vertical face 23 provides for exact edge alignment or registration of the sheets with other sheets in the trays to provide a neat package. In the sorter shown, the trays also have the flange 24 which aligns the trailing edges of the sheets, as the sheets tend to slide down the inclined trays in a direction opposite the infeed direction towards the rear flange.

As previously indicated, the cams 9 are operated to effect upward and downward movement of the trays T and their inner ends 2. The cams are adapted to be driven in opposite directions by a suitable reversable motor M1 (see FIG. 2) which drives the support shafts for the cams. Another motor M2 is adapted to drive the sheet infeed means 3 which include driven rolls mounted on the transversely extended shaft also seen in FIG. 2.

For the purposes of performing stapling operations, the stapler 11 is moved by the rack and pinion means 11*a* from the normally retracted position shown in FIGS. 1 and 2 to the stapling position shown in FIG. 5. In the stapling position the tray above the enlarged sheet entry space 4 is located adjacent to the throat 11b of the stapler. Each tray, at its inner end 2, and at the side thereof adjacent to the stapler is provided with a notch 2*a* in which the sets of sheets in the trays are adapted to be positioned in the stapler throat for reception of a staple. The sets of sheets in the tray above the tray in which a set is being stapled are displaced longitudinally by the stapler body upon movement of the stapler to the stapling position, in accordance with my pending application 730,746 referred to above.

Referring to FIGS. 3 and 4, it will be understood how the sets of sheets are laterally displaced in the trays by the jogging finger 20 during the stapling operations. As seen in FIG. 3, all of the sheets in the sets above the cam 20*a* have been displaced laterally against the registration surface 23, but the top sheet in the sets below cam 20a is in the position in which the sheet is received from the infeed means 3. However, upon upward movement of the trays below the cam 20*a* to the upper position, the action of the cam 20*a* moves jogger 20 laterally and the jogger displaces the last received sheet against the registration edge so that the entire set is in registration at the side edges thereof. Thereafter, the stapling operations are performed on fully registered sets of sheets as the trays are caused to move downwardly, sequentially to the stapling position.

From the foregoing, it will now be apparent that the invention provides a simple jogging mechanism which does not require separate drive means for actuation in timed relation to the sorting operations of the apparatus.

I claim:

1. A sorter comprising: a plurality of trays arranged in a vertical stack and extended horizontally, means for vertically shifting said trays sequentially to positions providing an enlarged sheet entry space for receiving sheets fed into said trays, a registration surface engageable by sheets in said trays to register the sheets at one side edge, said trays otherwise being closely spaced, and sheet jogging means for moving sheets in said trays towards said registration surface responsive to shifting of said trays.

2. A sorter as defined in claim 1, wherein said jogging means includes a jogging finger extending vertically at one side of said trays, said registration surface being at the other side of said trays, said trays and said finger having co-engageable camming surfaces to move said finger towards said registration surface.

3. A sorter as defined in claim 2, wherein said registration surface is on a frame supporting said trays.

4. A sorter as defined in claim 2, wherein said jogging finger is a resilient member normally in an inoperative position.

5. A sorter as defined in claim 1, including stapling means for stapling sets of sheets in said trays while said sets of sheets are in registration at their edges engaged with said registration surface.

6. A sorter as defined in claim 1, wherein said trays extend upwardly in the direction of sheet movement into said trays and said trays have a lower end flange at a right angle to said registration surface.

7. A sorter as defined in claim 1, wherein said jogging means includes a jogging finger extending vertically at one side of said trays through slots in said trays, said finger having an integral cam thereon engageable with an edge of said slots as said trays are shifted vertically relative to said jogging finger, said registration surface being at the other side of said trays.

* * * * *